United States Patent [19]

von Hagen

[11] 4,091,756

[45] May 30, 1978

[54] PNEUMATICALLY DRIVEN THREAD CUTTER

[75] Inventor: Wolf-Rüdiger von Hagen, Hemmingen, Germany

[73] Assignee: Union Special G.m.b.H., Stuttgart, Germany

[21] Appl. No.: 771,499

[22] Filed: Feb. 24, 1977

[30] Foreign Application Priority Data

Mar. 31, 1976 Germany ..... 2613728

[51] Int. Cl.[2] ..... D05B 65/06

[52] U.S. Cl. ..... 112/287; 112/288; 112/301; 112/DIG. 1

[58] Field of Search ..... 112/287, 288, 301, 293, 112/130, 129, DIG. 1, DIG. 2, DIG. 3

[56] References Cited

U.S. PATENT DOCUMENTS

| | | | |
|---|---|---|---|
| 3,143,987 | 8/1964 | Daniel et al. | 112/288 X |
| 3,403,648 | 10/1968 | Jarrett | 112/287 X |
| 3,489,115 | 1/1970 | Marforio | 112/288 |
| 3,541,984 | 11/1970 | Daniel | 112/288 X |
| 3,749,040 | 7/1973 | Jurgens | 112/288 X |
| 3,815,533 | 6/1974 | Brady | 112/287 |
| 3,934,526 | 1/1976 | Damast et al. | 112/288 X |

*Primary Examiner*—H. Hampton Hunter
*Attorney, Agent, or Firm*—John W. Harbst; John A. Schaerli

[57] ABSTRACT

A thread chain cutting mechanism for a sewing machine which includes a swingable blade which is actuated by means independent from the mechanical workings of the machine. The actuating mechanism includes a cantilevered resiliently urged member which carries at its free end the swingable cutter blade. A pneumatically operated plunger oscillates said resilient member and thus the blade carried thereby between a cutting position and a non-cutting position at a frequency which is adjustable. Means for providing a section in the cutting area so as to draw the thread chain into the path of the blades.

11 Claims, 2 Drawing Figures

PNEUMATICALLY DRIVEN THREAD CUTTER

This invention relates to a thread chain cutting device for sewing machines, and more particularly to an actuating mechanism for said chain cutting device.

BACKGROUND OF THE INVENTION

An important feature of this invention is the provision of an actuating mechanism which is independent of the drive mechanism of the machine. As shown in U.S. Pat. Nos. 3,143,987 and 3,541,984 there is provided a thread chain cutting mechanism which employs two horizontally disposed cutting blades for severing the thread chain formed between two garment workpieces. In the above two identified patents there is disclosed a mechanical linkage employed for swinging at least one of the two blades in a cutting relationship. This mechanical linkage is suitably connected to some driven part of the sewing machine which is operated on each cycle of operation in the machine As shown in U.S. Pat. No. 3,541,984 the mechanical linkage referred to is suitably connected to the feed bar of the sewing machine. However, the mechanical linkages heretofore provided have certain drawbacks. By driving a knife through a mechanical linkage additional forces and thus stresses are placed upon the feed mechanism of the machine. As is apparent, it is desirous to maintain the stresses in the machine as low as possible. Another drawback in employing mechanical linkage is that the wear on the parts is increased. A further disadvantage is the noise that is generated by the mechanical couplings associated therewith.

BRIEF DESCRIPTION OF THE INVENTION

In view of the above there is provided by the present invention a thread chain cutting mechanism for a sewing machine which is an improvement over U.S. Pat. No. 3,541,984. Whereas with the present invention there is provided a swingable blade which is actuated by means independent from the mechanical working of the machine. This aspect of the invention is made possible by providing a resiliently biased cantilevered beam for carrying the swingable cutter blade between a cutting and non-cutting position. A pneumatically operated pulsator or plunger oscillates the beam and thus the blade is carried on said beam into the cutting position whereby cooperating with a stationary blade in a severing relationship on the thread chain that has been drawn into the cutting path of said blade. The present invention also provides for an adjustment means whereby the frequency of oscillation of said plunger means can be adjusted. The plunger or piston which oscillates the cantilevered resilient beam is arranged to move between first and second positions. The piston is moved in response to an increase in pressure formed in a chamber which is connected to a fluid under pressure whereby the volume in the chamber means forcibly moves the plunger from its first position, wherein the piston is arranged to cover both the outlet opening in the chamber and a valve or exhaust port, to a second position, wherein the exhaust port is not covered by the plunger thus allowing the increased volume of pressure in the chamber to rapidly diminish. In view of the absence of pressure displacing the plunger the resiliently biased beam forcibly returns the swingable blade to its non-cutting position. The pressure which is exhausted from the chamber is directed to the area of the cutting blades whereby causing a suction effect thus drawing the thread chain into the path of the cutting blades.

In view of the above, it is a primary object of this invention to provide a means for externally driving the cutting mechanism of the machine.

It is another object of this invention to provide a means independent of the feed mechanism for driving the thread cutting mechanism whereby reducing the forces applied to the feed mechanism.

It is a further object of this invention to provide a drive mechanism which has a minimum of moving parts and is dependable in its operation.

It is another object of this invention to provide a drive mechanism whose response time is substantially independent of the rapidity of motion of a manually or otherwise displaceable element.

It is a further object of this invention to provide a drive means whose operating element is reciprocal between a cutting and non-cutting position at a frequency that is adjustable.

It is a further object of this invention to provide a means which is easy to maintain and adjust.

In the accompanying drawings annexed hereto and forming part of this specification, the present invention is shown embodied on an overedge sewing machine, but it will be understood that some of the features of this invention can be embodied in other machines and that the drawings are not to be construed as defining or limiting the scope of the invention, the claims appended to this specification being relied upon for that purpose.

DETAILED DESCRIPTION OF THE PREFERRED EMBODIMENT

Figure 1:
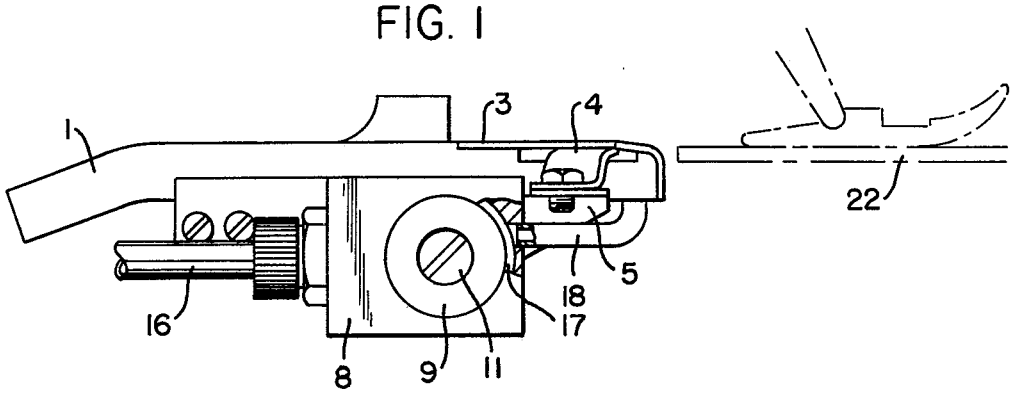
FIG. 1 is a side view of the cutting mechanism and related parts as applied to an overedge sewing machine.

The details of the sewing machine on which the present invention is employed are not shown in the drawings, but it may suitably be of the character illustrated and described in detail in the patent to Wallenberg et al U.S. Pat. No. 2,704,042 granted on Mar. 15, 1955. This is an overedge sewing machine of well known character arranged to provide a multiple thread overedge seam along one edge of the work being advanced through the machine. The invention may also be used in connection with a sewing machine adapted to form an overedge line of stitching, and parallel therewith an adjacent line of two thread chain stitching. Such a machine may, for example, be of the character shown in the patent to Schweda et al U.S. Pat No. 2,973,730 granted Mar. 7, 1961.

Referring now in greater detail to the various figures of the drawings wherein like reference characters refer to like parts, in FIG. 1, there is shown a tubular member means 1 which is provided for leading away, and delivering to a suitable disposal point, the cut thread chain as it is severed by the cutting blades by the present invention. The end of this tube which is adjacent the throat plate means 22 has a plate means 3. The plate means 3 has an inclined portion at its forward end which is provided with a plurality of opening means 2 and 2' into which the trailing thread chains may be readily drawn by suction created within the tube means 1 as will be described hereinafter. Plate means 3 and more particularly slot means 2 has an edge means 24 which forms a stationary knife blade.

Figure 2:
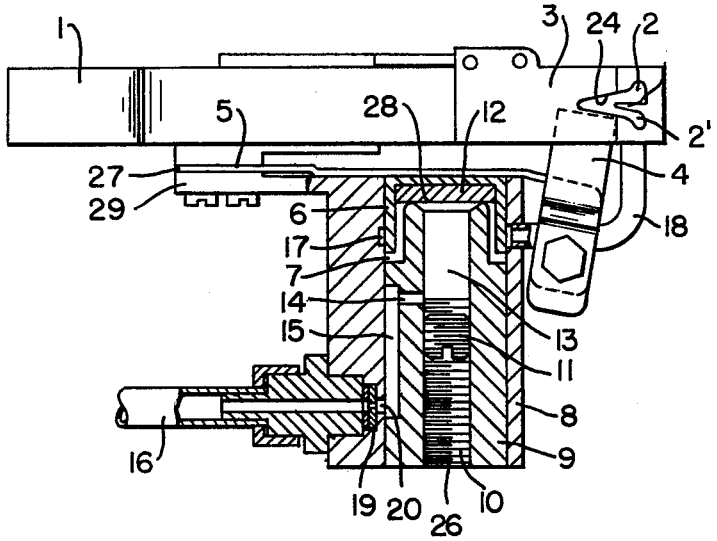
FIG. 2 is a top plan view, partially shown in section showing the detail of the actuating mechanism.

As is best seen in FIG. 2, cooperating with the knife edge means 24 is a knife means 4 which is fastened by any suitable means to a cantilevered leaf spring means 5. The spring means or beam 5 is secured at its first end means 27 between an extension 29 on housing 8 and the tube means 1. The lever means 5 is spring biased and rests against a piston or plunger means 6 so as to hold the blade means 4 in a non-cutting position as shown in FIG. 2. Instead of being frictionally connected to the piston or plunger means 6, the lever means 5 can of course be provided with a slot and be positively connected to the piston means 6 by a bolt screwed through the slot and into the piston means 6.

The piston or plunger means 6 is slideably mounted in a bore 7 in the housing 8. The piston means 6 is displaced between the lever means 5 and a circular inset means 9 which is fixedly secured within the bore means 7. The inset means 9 is provided with a aperture means 10 which is partially threaded from its first end means 26 and extends towards the cantilevered beam 5. An adjusting screw means 11 is threadably received in the threaded portion of the bore means 10 for adjustable movement as will be described hereinafter.

The piston or plunger means 6 has closely associated therewith a gasket means 12 which rests against the second end means 28 of inset means 9. Both the piston means 6 and the gasket means 12 are urged against the second end means 28 of the inset means 9 by the resiliently biased lever means 5. An air chamber means, generally indicated as 13, is formed between the gasket means 12 and the adjusting screw means 11. The air chamber means 13 is connected, via conduits 14, 15 and 20, to a pressurized source of fluid which is fed thereto via conduit 16. The bore means 7 is provided with an annular duct or valve means 17 which is connected via conduit means 18 to the tube means 1.

OPERATION OF THE DEVICE

In view of the pressurized source of air being connected via conduits 14, 15 and 20 to the air chamber means 13 an increasing volume air pressure pocket is created in the air chamber 13. Once the pressure in the air chamber means 13 exceeds the opposing force of the resiliently biased lever means 5, the piston or plunger means 6 is lifted off the second end means 28 of the inset 9 as a result of which the surface area of the piston 6 acted upon by the compressed air increases. Consequently, the piston means 6 is strongly accelerated whereby forcibly driving the knife 4 into a cutting relationship with the stationary blade means 24.

When the cutting blade 4 has been advanced into its cutting position, the piston means 6 has been advanced to a position whereby opening the annular duct or valve means 17 so that the air fed from the pressurized source of air through the conduits 14, 15 and 16 into the air chamber means 13 escapes into the conduit means 18 suddenly diminishing the pressure within the air chamber means 13. Due to the lack of air pressure displacing the piston means 6 the force inherent with the resiliently biased lever means 5 returns the piston means 6 to its first position wherein the gasket means 12 is again positioned on top of the second end means 28 and closes the valve means 17 whereby once again the build up of pressure within the air chamber means 13 commences.

The volume of the air chamber means 13, which determines the frequency and force at which the piston means 6 and therefore the blade means 4 which is in operative engagement therewith will be oscillated, can be altered by adjusting the lateral position of the adjusting screw means 11 within the threaded aperture means 10. As is apparent the closer that the adjustement means 11 is situated to the plunger means 6 the smaller will be the volume of the air chamber means 13 and the greater the frequency of oscillations. As the adjustment screw means 11 is backed away from the plunger means 6 the volume of the air chamber means 13 will be increased thus causing a longer period of time for the pressure necessary to displace the piston means 6 to build up therein whereby the oscillations of the plunger means 6 will be decreased. The frequency of the plunger means 6 is further determined by a throttle means 19 which is in the form of an orifice place means 19 which is located in front of conduit means 20 which leads into the conduit means 15.

The air escaping through conduit means 18 generates a suction causing a venturi effect and thus drawing the thread into the tube means 1 through opening 2 and 2'. After the thread chain has been severed by the cutting mechanism it is conveyed by the air stream through the tube means 1 and through a line means (not shown) to a storage bin also not shown in the drawings.

From the aforementioned description it should be clear that the advantages of such an actuating mechanism are numerous. By the present invention there is provided an actuating mechanism which effectively drives a cutting blade into a cutting position but yet is independent from the operating mechanism of the machine. By providing that the frequency of oscillations of the cutting blade is readily adjustable, it is apparent that the force between the cutting blades may be adjusted to allow for different type threads. In keeping an actuating mechanism for the cutting blades which is independent from the operating mechanism of the machine, less stresses and less forces are placed upon the driven members of the machine whereby lessening the wear placed upon these parts.

Thus it is apparent that there has been provided in accordance with the present invention, a pneumatically driven thread cutter that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended that all such alternatives, modifications, and variations fall within the spirit and broad scope of the appended claims.

What is claimed is:

1. A thread chain cutting device including tube means for receiving said thread chain, an opening in said tube means for allowing passage of said chain into said tube means, a stationary knife means and a moveable knife means disposed closely adjacent said opening means for cutting said chain, and actuating means comprising:

a fluid operated pulsator means in operative engagement with said moveable knife means for forcibly driving said moveable knife means into a cutting relationship with said stationary knife means in a series of substantially uninterrupted non-harmonic feed movements.

2. A thread chain cutting device including an enclosed tubular member means for receiving said thread chain, an opening means in said tubular member means permitting the chain of thread to pass therethrough into said tubular member, thread severing means disposed closely adjacent said opening means and having at least one moveable blade means, and an actuating means comprising:

a housing means;

valve means in said housing means;

chamber means in said housing means, said chamber means being connected to a fluid under pressure;

piston means operatively connected to said moveable blade means for influencing movement of said moveable blade means in substantially uninterrupted successive non-harmonic movements in response to an increase in pressure within said chamber means, said piston means being moveable between a first position wherein said piston means closes said valve means and a second position wherein said piston means opens said valve means; and means for resiliently biasing said piston means toward said first position.

3. The thread chain cutting device of claim 2 wherein said means for resiliently biasing is a cantilevered spring means connected to said housing means.

4. The thread chain cutting device of claim 3 wherein said spring means biases said piston means toward said chamber means.

5. The thread chain cutting device of claim 2 further including means for adjusting the volume of said chamber means.

6. The thread chain cutting device of claim 5 wherein said means for adjusting comprises means laterally adjustable in said housing means.

7. The thread chain cutting device of claim 2 further including conduit means connecting said valve means and said tubular member means for creating a suction in the interior of said tubular member means for drawing said thread chain thereinto.

8. In a sewing machine having a frame means adapted to form a thread chain between successive work pieces, a thread chain cutting device for severing said chain including a pair of knives, one of said knives being swingable in the plane of its cutting edge, the combination therewith of operating mechanism for said cutting device comprising:

a resiliently biased lever means;

means securing said swingable knife to said lever means;

housing means including conduit means connected to a fluid under pressure;

plunger means displaceable by said pressurized fluid means for reciprocating said lever means; and valve means associating with said conduit means and said plunger means for allowing movement of said plunger means in the other reciprocating direction.

9. The combination defined in claim 8 wherein said resiliently biased lever means is a cantilevered beam.

10. In a sewing machine having means adapted to form a thread chain between successive work pieces, a thread chain cutting device for severing said chain including a pair of knives, at least one of said knives being moveable in the plane of its cutting edge, the combination therewith of an operating mechanism for said cutting device comprising:

means positioned adjacent said cutting device including means for connection to a source of fluid pressure whereby allowing pressure differentials to be created within the interior of said first said means;

valve means in operative association with the interior of said first said means for intermittently exhausting pressure created therein;

plunger means slideably positioned between said valve means and the interior of said housing means and operative in response to a build up of pressure therein so as to move said moveable knife means into a cutting relationship with the other of said knives when said valve means is covered by said plunger means.

11. The combination defined in claim 10 further including means for adjusting the frequency and force of movement of said moveable blade means.

* * * * *